US012599237B2

(12) United States Patent
Koch

(10) Patent No.: US 12,599,237 B2
(45) Date of Patent: Apr. 14, 2026

(54) CHAIR WITH FLEXIBLE INTERNAL SUPPORT

(71) Applicant: HNI Technologies Inc., Muscatine, IA (US)

(72) Inventor: John Koch, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 364 days.

(21) Appl. No.: 18/201,446

(22) Filed: May 24, 2023

(65) Prior Publication Data

US 2023/0292925 A1 Sep. 21, 2023

Related U.S. Application Data

(62) Division of application No. 17/166,968, filed on Feb. 3, 2021, now Pat. No. 11,690,457.

(60) Provisional application No. 62/970,048, filed on Feb. 4, 2020.

(51) Int. Cl.

| | |
|---|---|
| ***A47C 7/18*** | (2006.01) |
| ***A47C 7/28*** | (2006.01) |
| ***A47C 7/40*** | (2006.01) |
| *A47C 5/12* | (2006.01) |

(52) U.S. Cl.

CPC ..... *A47C 7/185* (2013.01); *A47C 7/282* (2013.01); *A47C 7/40* (2013.01); *A47C 5/12* (2013.01)

(58) Field of Classification Search

CPC ..... A47C 7/40

See application file for complete search history.

(56) References Cited

U.S. PATENT DOCUMENTS

| | | | | |
|---|---|---|---|---|
| 4,660,887 | A | 4/1987 | Fleming et al. | |
| 4,744,603 | A | 5/1988 | Knoblock | |
| 4,892,356 | A | 1/1990 | Pittman et al. | |
| 4,965,899 | A * | 10/1990 | Sekido | A47C 7/467 297/284.6 |
| 5,100,201 | A | 3/1992 | Becker et al. | |
| 5,102,196 | A | 4/1992 | Kaneda et al. | |
| 5,318,346 | A | 6/1994 | Roossien et al. | |
| 5,333,934 | A | 8/1994 | Knoblock | |
| 5,338,099 | A | 8/1994 | Ishi et al. | |
| 5,352,022 | A | 10/1994 | Knoblock | |

(Continued)

FOREIGN PATENT DOCUMENTS

| | | |
|---|---|---|
| AU | 2001065653 | 4/2002 |
| CA | 2881691 A1 | 3/2014 |

(Continued)

*Primary Examiner* — Alison L Hindenlang
*Assistant Examiner* — Debjani Roy
(74) *Attorney, Agent, or Firm* — Faegre Drinker Biddle & Reath LLP

(57) ABSTRACT

The present disclosure relates to a chair back assembly with an outer frame and an inner frame, wherein the outer frame is manufactured of different material than the inner frame to allow for a variety in support throughout the chair back assembly, resulting in localized support throughout the back of the chair. The availability of localized support results in an improvement in comfort and may also improve production in embodiments utilizing a foam covering. Specifically, the inner frame of the chair back assembly may include at least one vertical member and at least one horizontal member to provide additional support to the user.

20 Claims, 5 Drawing Sheets

(56) References Cited

U.S. PATENT DOCUMENTS

| | | | | |
|---|---|---|---|---|
| 5,378,040 | A | 1/1995 | Chaney et al. | |
| 5,487,591 | A | 1/1996 | Knoblock | |
| 5,540,481 | A | 7/1996 | Roossien et al. | |
| 5,611,598 | A | 3/1997 | Knoblock | |
| 5,662,381 | A | 9/1997 | Roossien et al. | |
| 5,906,416 | A | 5/1999 | Rasmussen | |
| 5,934,758 | A | 8/1999 | Ritch et al. | |
| 5,961,184 | A | 10/1999 | Balderi et al. | |
| 6,131,993 | A | 10/2000 | Pesta et al. | |
| 6,257,665 | B1 | 7/2001 | Nagamitsu et al. | |
| 6,382,719 | B1 | 5/2002 | Heidmann et al. | |
| 6,419,318 | B1 | 7/2002 | Albright | |
| 6,626,497 | B2 | 9/2003 | Nagamitsu et al. | |
| 6,669,292 | B2 | 12/2003 | Koepke et al. | |
| 6,783,184 | B2 | 8/2004 | Dibattista et al. | |
| 7,216,933 | B2 | 5/2007 | Schmidt et al. | |
| 7,347,495 | B2 | 3/2008 | Beyer et al. | |
| 7,604,298 | B2 | 10/2009 | Peterson et al. | |
| 7,625,044 | B2 | 12/2009 | Piretti | |
| 7,654,616 | B2 | 2/2010 | Kinoshita et al. | |
| 7,841,666 | B2 | 11/2010 | Schmitz et al. | |
| 8,251,454 | B2 | 8/2012 | Tsukiji et al. | |
| 8,602,501 | B2 | 12/2013 | Walker et al. | |
| D715,068 | S | 10/2014 | Chan | |
| 8,876,209 | B2 | 11/2014 | Peterson et al. | |
| 8,973,990 | B2 | 3/2015 | Krupiczewicz et al. | |
| 8,998,338 | B2 | 4/2015 | Vander et al. | |
| 8,998,339 | B2 | 4/2015 | Peterson et al. | |
| 9,332,851 | B2 | 5/2016 | Machael et al. | |
| 9,462,891 | B2 | 10/2016 | Kikuchi et al. | |
| 9,913,539 | B2 | 3/2018 | Potrykus et al. | |
| 10,016,061 | B2 * | 7/2018 | Brueske | A47C 7/462 |
| 10,064,493 | B2 | 9/2018 | Machael et al. | |
| 10,172,464 | B2 | 1/2019 | Cassaday | |
| 10,172,465 | B2 | 1/2019 | Machael et al. | |
| 10,182,657 | B2 | 1/2019 | Beyer et al. | |
| 10,219,627 | B2 | 3/2019 | Deevers et al. | |
| 10,264,889 | B2 | 4/2019 | Battey et al. | |
| D879,491 | S | 3/2020 | Wang | |
| 10,729,250 | B2 | 8/2020 | Beyer et al. | |
| 10,791,842 | B2 | 10/2020 | Peterson et al. | |
| 10,820,705 | B2 | 11/2020 | Deevers et al. | |
| D912,417 | S | 3/2021 | Chen | |
| D937,593 | S | 12/2021 | Ni et al. | |
| 11,690,457 | B2 | 7/2023 | Koch | |
| 2002/0190552 | A1 | 12/2002 | Koepke et al. | |
| 2003/0042783 | A1 | 3/2003 | Potes et al. | |
| 2003/0127896 | A1 | 7/2003 | Deimen et al. | |
| 2004/0032156 | A1 | 2/2004 | Stipek | |
| 2004/0245825 | A1 | 12/2004 | Battey et al. | |
| 2004/0245827 | A1 | 12/2004 | Bedford et al. | |
| 2005/0248189 | A1 | 11/2005 | Prasatek et al. | |
| 2006/0071522 | A1 | 4/2006 | Bedford et al. | |
| 2006/0175884 | A1 | 8/2006 | Jenkins | |
| 2007/0267911 | A1 | 11/2007 | Kinoshita et al. | |
| 2008/0217977 | A1 | 9/2008 | Aldrich et al. | |
| 2010/0033002 | A1 | 2/2010 | Di Giusto et al. | |
| 2010/0117433 | A1 | 5/2010 | Cassaday | |
| 2010/0133893 | A1 | 6/2010 | Raftery et al. | |
| 2012/0212027 | A1 | 8/2012 | Nakayama et al. | |
| 2012/0223566 | A1 | 9/2012 | Nakayama et al. | |
| 2013/0169014 | A1 | 7/2013 | Machael et al. | |
| 2014/0077541 | A1 | 3/2014 | Krupiczewicz et al. | |
| 2014/0077542 | A1 | 3/2014 | Vander et al. | |
| 2014/0077548 | A1 * | 3/2014 | Peterson | A47C 1/03274 297/284.4 |
| 2014/0077549 | A1 | 3/2014 | Battey et al. | |
| 2014/0077551 | A1 | 3/2014 | Battey et al. | |
| 2014/0077552 | A1 | 3/2014 | Battey et al. | |
| 2014/0077553 | A1 | 3/2014 | Battey et al. | |
| 2014/0077555 | A1 | 3/2014 | Battey et al. | |
| 2014/0077556 | A1 | 3/2014 | Battey et al. | |
| 2014/0077557 | A1 | 3/2014 | Battey et al. | |
| 2014/0077571 | A1 | 3/2014 | Vander et al. | |
| 2014/0077572 | A1 | 3/2014 | Vander et al. | |
| 2014/0084652 | A1 | 3/2014 | Norman et al. | |
| 2015/0042139 | A1 | 2/2015 | Namekawa et al. | |
| 2015/0091353 | A1 | 4/2015 | Horn | |
| 2015/0157127 | A1 | 6/2015 | Peterson et al. | |
| 2015/0157128 | A1 | 6/2015 | Battey et al. | |
| 2015/0164226 | A1 | 6/2015 | Battey et al. | |
| 2015/0164227 | A1 | 6/2015 | Battey et al. | |
| 2015/0164230 | A1 | 6/2015 | Smith et al. | |
| 2015/0250319 | A1 * | 9/2015 | Burwell | A47C 1/03255 428/105 |
| 2015/0265053 | A1 | 9/2015 | Battey et al. | |
| 2015/0296989 | A1 | 10/2015 | Machael et al. | |
| 2015/0305505 | A1 | 10/2015 | Peterson et al. | |
| 2015/0321614 | A1 | 11/2015 | Line et al. | |
| 2016/0029801 | A1 | 2/2016 | Potrykus et al. | |
| 2016/0081477 | A1 | 3/2016 | Coffield | |
| 2016/0135603 | A1 | 5/2016 | Chan et al. | |
| 2016/0206105 | A1 | 7/2016 | Wagner | |
| 2016/0309901 | A1 | 10/2016 | Battey et al. | |
| 2016/0360889 | A1 | 12/2016 | Matlin et al. | |
| 2016/0367029 | A1 | 12/2016 | Battey et al. | |
| 2017/0007022 | A1 | 1/2017 | Battey et al. | |
| 2017/0245642 | A1 | 8/2017 | Smith et al. | |
| 2018/0042384 | A1 | 2/2018 | Battey et al. | |
| 2018/0116405 | A1 | 5/2018 | Gerbino et al. | |
| 2018/0160813 | A1 | 6/2018 | Battey et al. | |
| 2018/0177301 | A1 * | 6/2018 | Norman | A47C 7/24 |
| 2018/0271292 | A1 | 9/2018 | Wu | |
| 2019/0133322 | A1 | 5/2019 | Peterson et al. | |
| 2019/0133323 | A1 | 5/2019 | Battey et al. | |
| 2019/0133326 | A1 | 5/2019 | Battey et al. | |
| 2019/0167007 | A1 | 6/2019 | Deevers et al. | |
| 2020/0288871 | A1 | 9/2020 | Deevers et al. | |
| 2020/0345142 | A1 | 11/2020 | Battey et al. | |
| 2021/0204699 | A1 | 7/2021 | Deevers et al. | |
| 2021/0227981 | A1 | 7/2021 | Battey et al. | |
| 2021/0235872 | A1 | 8/2021 | Koch | |
| 2021/0401181 | A1 | 12/2021 | Putman | |

FOREIGN PATENT DOCUMENTS

| | | | |
|---|---|---|---|
| CA | 2956562 | A1 | 8/2017 |
| DE | 102018123731 | A1 | 3/2020 |
| EP | 1226773 | A1 | 7/2002 |
| EP | 0979050 | A4 | 11/2002 |
| EP | 1215981 | A4 | 4/2005 |
| EP | 3245901 | A1 | 11/2017 |
| GB | 0466729 | A | 6/1937 |
| GB | 0973731 | A | 10/1964 |
| HK | 1010664 | A1 | 6/1999 |
| HK | 1017597 | | 11/1999 |
| IN | 215418 | | 4/2007 |
| KR | 30-0790204 | | 3/2015 |
| KR | 10-2015-0134905 | A | 12/2015 |
| WO | 98/48671 | A1 | 11/1998 |
| WO | 01/22849 | A1 | 4/2001 |

* cited by examiner

CHAIR WITH FLEXIBLE INTERNAL SUPPORT

CROSS-REFERENCE TO RELATED APPLICATION

This application claims priority to and is a divisional application of U.S. patent application Ser. No. 17/166,968, filed Feb. 3, 2021, which claims priority to U.S. Provisional Application No. 62/970,048, filed Feb. 4, 2020, the contents of which are herein incorporated by reference in their entirety.

BACKGROUND

Chair backs are designed to meet a variety of criteria, including user acceptance, and manufacturability. Improvements are sought to provide users with chair backs that are comfortable, provide adequate support, and are able to be manufactured effectively. The wide selection of available design materials and ergonomic design considerations present a nearly limitless set of possible design selections, not to mention the associated aesthetic design considerations that come into play.

SUMMARY

The present disclosure relates to molded chair back assemblies that can achieve a variety of benefits, including ease of manufacturability and desirable form, fit and function. The combination of a webbing, or web material with a molded secondary material, such as a foam, has been found to promote a variety of these considerations. Thus, various examples relate to a chair back assembly with an outer frame and an inner frame, where the outer frame is manufactured of different material than the inner frame to allow for varying support throughout the chair back assembly, resulting in varying, localized support throughout the back of the chair. The availability of localized support results in an improvement in comfort and may also improve production in embodiments utilizing a molded, foam covering. Specifically, the inner frame of the chair back assembly may include a framework, or webbing of at least one vertical member and at least one horizontal member that define a closed cell framework with an associated foam filler that provides tailored support to a human back.

In an example ("Example 1") of the present disclosure, a chair back assembly is disclosed. The chair back assembly comprises an outer frame defining an open central region and being formed of a frame material; an inner frame coupled to the outer frame defining a central longitudinal axis and a central latitudinal axis, the inner frame extending across the open central region of the outer frame, the inner frame formed of a web material including a crossing-pattern of inner frame elements that define a plurality of closed cells that are symmetric in shape about the central longitudinal axis of the inner frame, the frame material being relatively more rigid than the web material; and a foam layer enveloping the outer frame and the inner frame and filling the closed cells of the inner frame.

In another example ("Example 2") of the present disclosure, a method of manufacturing a chair back is disclosed. The method provides the steps of forming an outer frame defining an open central region and being formed of a frame material; forming an inner frame defining a central longitudinal axis and a central latitudinal axis, the inner frame being formed of a web material including a crossing-pattern of inner frame elements that define a plurality of closed cells that are symmetric in shape about the central longitudinal axis of the inner frame, wherein the web material is relatively less rigid than the frame material; coupling the inner frame to the outer frame so that the inner frame stretches across the open central region of the outer frame; placing the coupled inner frame and outer frame into a chair mold; and pouring liquid foam into the chair mold to cover the coupled inner frame and outer frame.

The inner frame elements of Example 1 or Example 2 may include a first vertical frame element and a second vertical frame element, such that the plurality of closed cells define a first vertical zone, a second vertical zone, and a third vertical zone, the first vertical zone being separated from the second vertical zone by the first vertical frame element and the second vertical zone being separated from the third vertical zone by the second vertical frame element. The first and second frame elements may diverge from one another in a downward direction from a top of the inner frame element toward a bottom of the inner frame, such that the first and third vertical zones decrease in width in a downward direction from a top of the inner frame element toward a bottom of the inner frame.

The inner frame elements of Example 1 or Example 2 may include a plurality of horizontal frame elements such that the plurality of closed cells define a plurality of horizontal zones separated by the plurality of horizontal frame elements. A first set of the plurality of horizontal frame elements may extend across a width of the inner frame with an upward curvature and a second set of the plurality of horizontal frame elements may extend across a width of the inner frame with a downward curvature, the first set being located on an upper portion of the inner frame and the second set being located on a lower portion of the inner frame.

A mid-region of the inner frame of Example 1 or Example 2 may define a saddle-shape. A majority of the plurality of closed cells of Example 1 or Example 2 may be generally quadrilateral in shape. The frame material of Example 1 or Example 2 may be glass-reinforced nylon. The web material of Example 1 or Example 2 may be thermoplastic vulcanizate. The inner frame and the outer frame of Example 1 or Example 2 may be coupled through the process of heat-staking. The outer frame of Example 1 or Example 2 may include a first side, second side, a top, and a bottom defining a continuous perimeter encircling the open central region.

While multiple embodiments are disclosed, still other embodiments within the inventive scope of the disclosure will become apparent to those skilled in the art from the following drawings and detailed description, which shows and describes illustrative embodiments. Accordingly, the drawings and detailed description are to be regarded as illustrative in nature and not restrictive.

BRIEF DESCRIPTION OF THE DRAWINGS

A detailed description of the drawings particularly refers to the accompanying figures in which.

DETAILED DESCRIPTION

Figure 1:
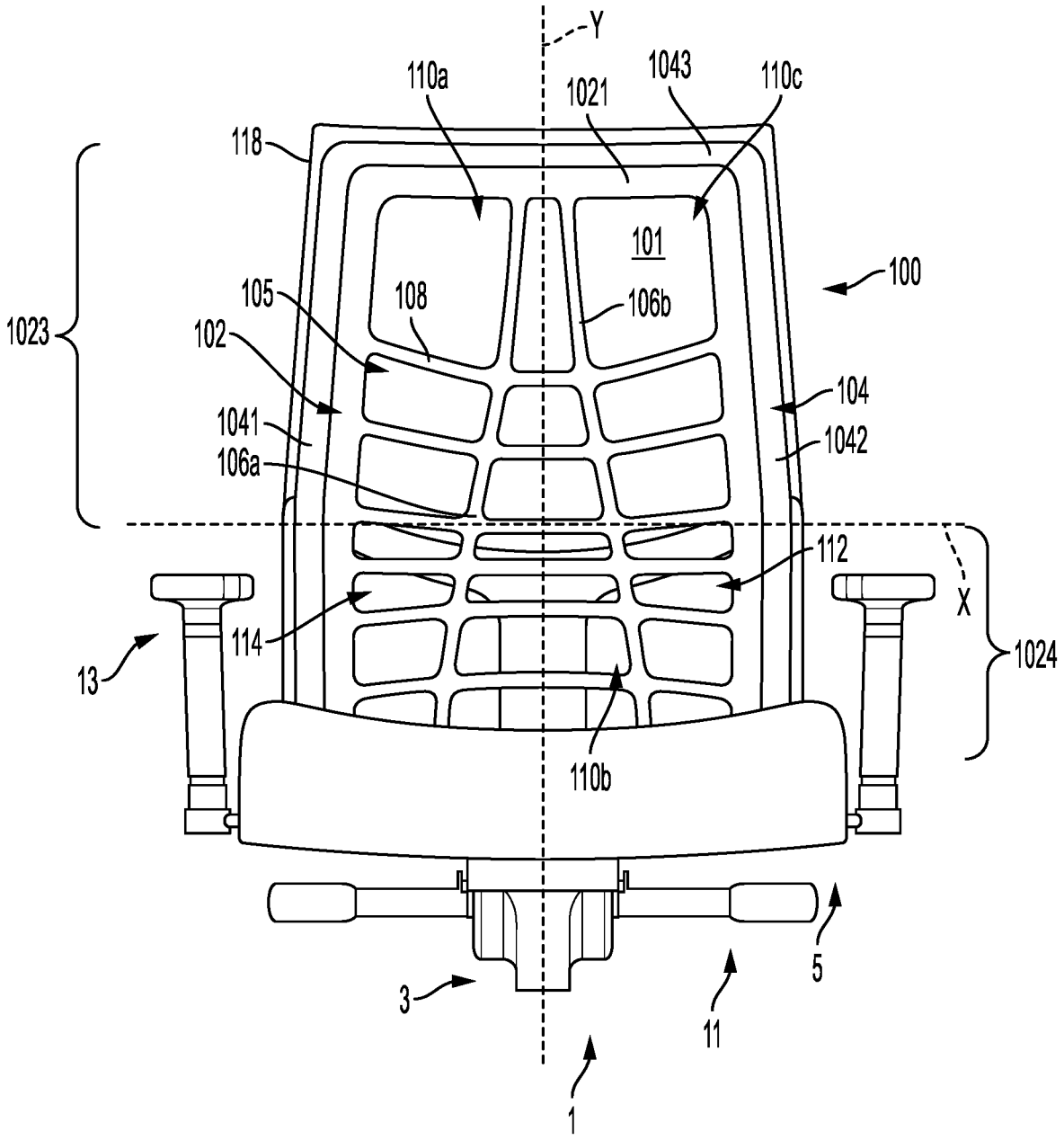
FIG. 1 is a front view of an exemplary embodiment of a chair back of the present invention, including a web-like structure which comprises an inner frame of the chair back, wherein the inner frame of the chair back is melted onto or otherwise coupled to an outer frame of the chair back.

Persons skilled in the art will readily appreciate that various aspects of the present disclosure can be realized by any number of methods and apparatus configured to perform the intended functions. It should also be noted that the accompanying drawing figures referred to herein are not necessarily drawn to scale but may be exaggerated to illustrate various aspects of the present disclosure, and in that regard, the drawing figures should not be construed as limiting.

Definitions and Terminology

With respect terminology of inexactitude, the terms "about" and "approximately" may be used, interchangeably, to refer to a measurement that includes the stated measurement and that also includes any measurements that are reasonably close to the stated measurement. Measurements that are reasonably close to the stated measurement deviate from the stated measurement by a reasonably small amount as understood and readily ascertained by individuals having ordinary skill in the relevant arts. Such deviations may be attributable to measurement error or minor adjustments made to optimize performance, for example. In the event it is determined that individuals having ordinary skill in the relevant arts would not readily ascertain values for such reasonably small differences, the terms "about" and "approximately" can be understood to mean plus or minus 10% of the stated value.

Certain terminology is used herein for convenience only. For example, words such as "top", "bottom", "upper," "lower," "left," "right," "horizontal," "vertical," "upward," and "downward" merely describe the configuration shown in the figures or the orientation of a part in the installed position. Indeed, the referenced components may be oriented in any direction. Similarly, throughout this disclosure, where a process or method is shown or described, the method may be performed in any order or simultaneously, unless it is clear from the context that the method depends on certain actions being performed first.

This disclosure is not meant to be read in a restrictive manner. For example, the terminology used in the application should be read broadly in the context of the meaning those in the field would attribute such terminology.

DESCRIPTIONS OF THE DISCLOSED EMBODIMENTS

Figure 2:
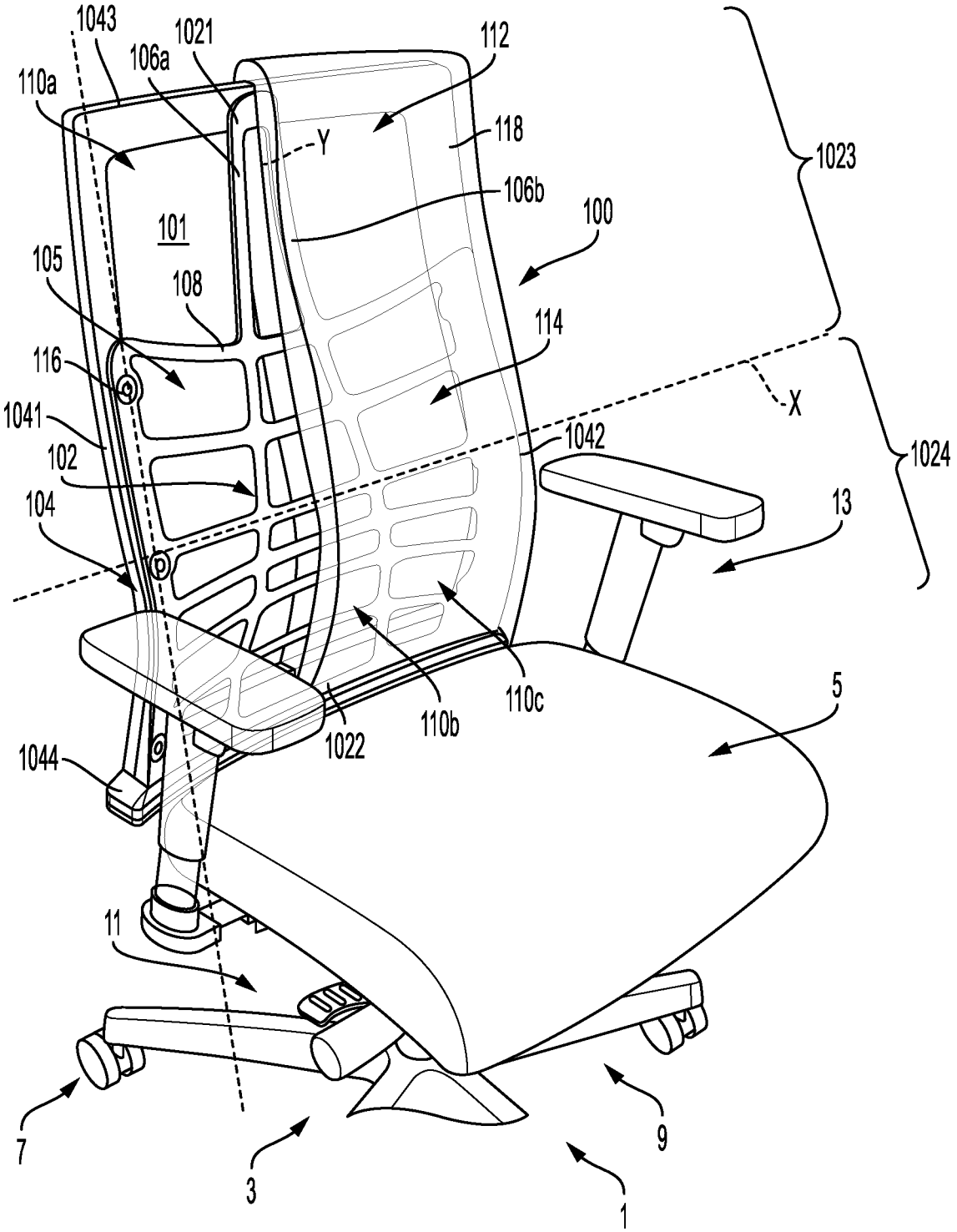
FIG. 2 is a perspective view of an exemplary embodiment of a chair back of the present invention similar to the chair back of FIG. 1, wherein the inner frame is coupled to the frame using fasteners and further includes a foam molding over the inner frame and the outer frame.

Referring initially to FIGS. 1 and 2, a chair 1 according to an illustrative embodiment is disclosed. The chair 1 may be used in a variety of environments, including an office building, a home office, a living space, a bedroom, outdoors, and anywhere a user may want to have a place to sit down. The chair 1 may include a base 3, which generally extends from a floor or the ground of the relative environment to support a seat 5. The seat 5 is configured to support a user during use, for example, for a user to sit upon. The base 3 may include wheels 7 (FIG. 2) to facilitate mobility of the chair 1 around the environment in which the chair 1 is being used. In other embodiments, the chair 1 may not include wheels 7 (FIG. 2), but may otherwise be removably placed on the floor or the ground of the environment in which the chair 1 is being used. For example, the base 3 may include legs 9 (FIG. 2) without wheels 7 (FIG. 2) which rest on the floor or the ground and further support the base. In yet other embodiments, the chair 1 may be fixedly attached to the floor or the ground through the use of cement, concrete, bolts, or other fastening means.

The base 3 may further include a height adjuster 11, which allows the user to adjust the height of the seat 5 to adapt to the environment and purpose for which the chair 1 is being utilized. In other words, the chair 1 may be a pneumatic chair. In such an embodiment, the chair 1 includes a gas cylinder (not shown) to store compressed air and a piston (not shown) coupled to the gas cylinder, both of which are built into the base 3. Upon actuation of the height adjuster 11 in a first direction, the piston enters the gas cylinder to further compress the air inside the cylinder, which raises the seat 5 of the chair 1. Upon actuation of the height adjuster 11 in a second direction, the piston exits the gas cylinder, decompressing the trapped air and causing the seat 5 to lower.

The chair 1 may also include arm rests 13, which extend from either the base 3 or the seat 5 to a position at which a user may comfortably rest his or her arms on the arm rests 13 while utilizing the chair 1. The arm rests 13 may be adjustable in height and direction to fit the needs of the user. A chair back 100 may also extend from the seat 5 or may be otherwise supported by the base 3 to a height at which the user may rest his or her back on the chair back 100. The chair back 100 may recline or may be varying degrees of rigidly upright depending on the needs of the user and the purpose of the chair 1.

Referring to FIG. 1, the chair back 100 of chair 1 is further disclosed. In the illustrative embodiment, the chair back 100 has an outer frame 104 forming an outer ring and defining an open central region 101. Specifically, the outer frame 104 includes a first side 1041, a second side 1042, a third side or top 1043, and a fourth side or bottom 1044 (FIG. 2) which are coupled to form a continuous perimeter defining the open central region 101. The chair back 100 further has an inner frame 102 forming a crossing-pattern or webbing of inner frame elements. Specifically, the inner frame 102 has a plurality of vertical frame elements 106 and at least one or more horizontal frame elements 108 which define a plurality of closed cells 112, the composite of which form a web-like structure 105.

Illustratively, the inner frame 102 and the outer frame 104 have varying resistance. For example, in an exemplary embodiment, the inner frame 102 may be comprised of an elastomer, such as thermoplastic vulcanizate or another thermoplastic elastomer. In such an embodiment, the outer frame 104 may be made of a more rigid polymer, such as glass-reinforced nylon or other reinforced composite polymers. In another embodiment, the inner frame 102 and the outer frame 104 may be comprised of the same material, wherein the outer frame 104 is manufactured in a manner so that the material is dense and rigid whereas the inner frame 102 is manufactured in a manner so that the material is relatively more flexible than the outer frame structure 104. The structural support of the chair back 100 is achieved through the rigidity of the outer frame 104, as seated contact with the frame is greatly minimized due to the design of the chair back 100 as described herein.

As discussed above, the inner frame 102 may form a web-like structure 105 to provide support to a back of a user. For example, the inner frame 102 defines a longitudinal axis Y and a central latitudinal axis X, wherein the inner frame 102 may include at least a first vertical frame element 106*a* and a second vertical frame element 106*b* that correspond with the longitudinal axis Y to define a first vertical zone 110*a*, a second vertical zone 110*b*, and a third vertical zone 110*c*. In other embodiments, more or fewer vertical zones 110 may be included. In other words, the web-like structure 105 may provide additional or fewer vertical frame elements 106 defining additional or fewer vertical zones 110. The vertical frame elements 106 may have a similar or different arrangement to that portrayed by FIG. 1 relative to the longitudinal axis Y. The number and arrangement of vertical frame elements 106 determine the comfort level of the user, as well as the amount of support given to the user's spine.

As shown, the vertical zones 110 may change in size and shape along the longitudinal axis Y of the inner frame 102. For example, the first vertical frame element 106*a* and the second vertical frame element 106*b* may diverge from one another in a downward direction from a top 1021 of the inner frame 102 toward a bottom 1022 (FIG. 2) of the inner frame 102 so that the first vertical zone 110*a* and the third vertical zone 110*c* decrease in width in a downward direction from the top 1021 of the inner frame 102 toward the bottom 1022 (FIG. 2) of the inner frame 102 and the second vertical zone 110*b* increases in width in a downward direction from the top 1021 of the inner frame 102 toward the bottom 1022 of the inner frame 102.

The inner frame 102 may further include a plurality of horizontal frame elements 108 corresponding to the latitudinal axis X of the inner frame 102. The horizontal frame elements 108 form a crossing-pattern with the vertical frame elements 106 to define a plurality of closed cells 112, the composite of which form the web-like structure 105. The plurality of closed cells 112 are generally quadrilateral in shape and may be symmetric in a shape about the longitudinal axis Y of the inner frame 102.

The horizontal frame elements 108 further define a plurality of horizontal zones 114. Each of the horizontal zones 114 are separated by respective horizontal frame elements 108. In an illustrative embodiment, a first set of the plurality of horizontal frame elements 108 is located within an upper portion 1023 of the inner frame 102; the plurality of horizontal frame elements 108 defining the first set extending across the width of the inner frame 102 with a curvature toward the top 1021 of the inner frame 102. A second set of the plurality of horizontal frame elements 108 is located within a lower portion 1024 of the inner frame 102; the plurality of horizontal frame elements 108 defining the second set extending across the width of the inner frame 102 with a curvature toward the bottom 1022 of the inner frame 102. Generally, a majority of the horizontal frame elements 108 are located in the lower portion 1024 of the inner frame 102 to provide additional support along the perceived middle back and lumbar areas of a user's back, while the upper portion 1023 has fewer horizontal frame elements 108, giving less support along the latitudinal axis X of the inner frame 102 in the perceived areas of the user's shoulder blades. The arrangement of the horizontal frame elements 108 may, for example, define a saddle-shape in the mid-region of the inner frame 102 to provide additional support in the perceived lumbar area of the user's back. Additional or fewer horizontal frame elements 108 may be provided in a similar or different arrangement. For example, the upper portion 1023 may be substantially free of horizontal frame elements 108. The ability to modify the amount of support through alteration of the design of the support material in the inner frame 102 allows the benefit of a localized reaction.

To form the assembled chair back 100, the inner frame 102 and the outer frame 104 are formed and subsequently coupled so that the inner frame 102 is extended across the open central region 101 of the outer frame 104. Illustratively, the inner frame 102 and the outer frame 104 may be coupled through heat-staking. For example, the inner frame 102 and the outer frame 104 may be arranged in the desired formation described above and then undergo a pulsed-heat process that at least partially deforms the inner frame 102 and/or the outer frame 104 so that the inner frame 102 and the outer frame 104 are bonded together, i.e. melted together. Referring additionally to FIG. 2, in another embodiment, the inner frame 102 and the outer frame 104 may be coupled using fasteners 116, such as bolts, screws, nails, staples, adhesive, or other manners of coupling one thing to another.

Figure 3:
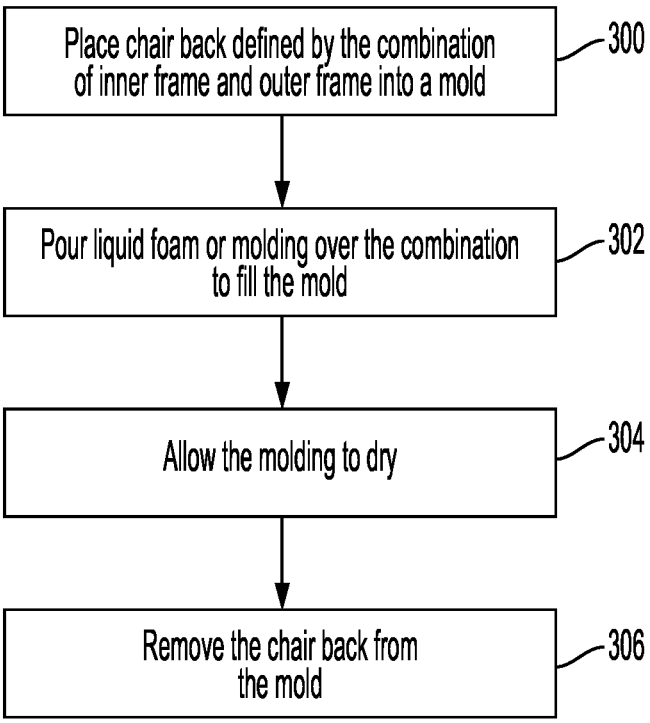
FIG. 3 is a diagrammatic view of a method for manufacturing the chair back of FIG. 1 or FIG. 2 with a foam molding.

Still referring to FIGS. 1 and 2, the chair 1 may include a foam layer 118 as shown in FIG. 2 and portrayed by the outline 118*b* in FIG. 1. In an illustrative embodiment, according to the method in FIG. 3, the combination of the coupled inner frame 102 and the outer frame 104 are placed in a mold corresponding to the desired shape of the chair back 100, according to box 300. Then, liquid foam, or molding, is poured over the combination to fill the mold of the chair back 100, according to box 302. As shown in box 304, the molding is permitted to dry so that the foam layer 118 may conform to and hold the shape of the mold. In this way, the foam layer 118 may fill the plurality of closed cells 112 of the inner frame 102. After the molding has completed drying, the chair back 100 is removed from the mold according to box 306 so that assembly of the chair 1 may be completed. In other embodiments, the foam layer 118 may be formed over the inner frame 102 and the outer frame 104 via injection molding or a casting process.

The foam layer 118 provides a level of comfort and support separate from the combination of the inner frame 102 and the outer frame 104. Where the web-like structure 105 exists under the foam layer 118, additional support is provided to a user. The web-like structure 105 may be modified as discussed above. For example, support material in the inner frame 102 may be removed where support is not needed to improve flow of the foam material.

Figure 4:
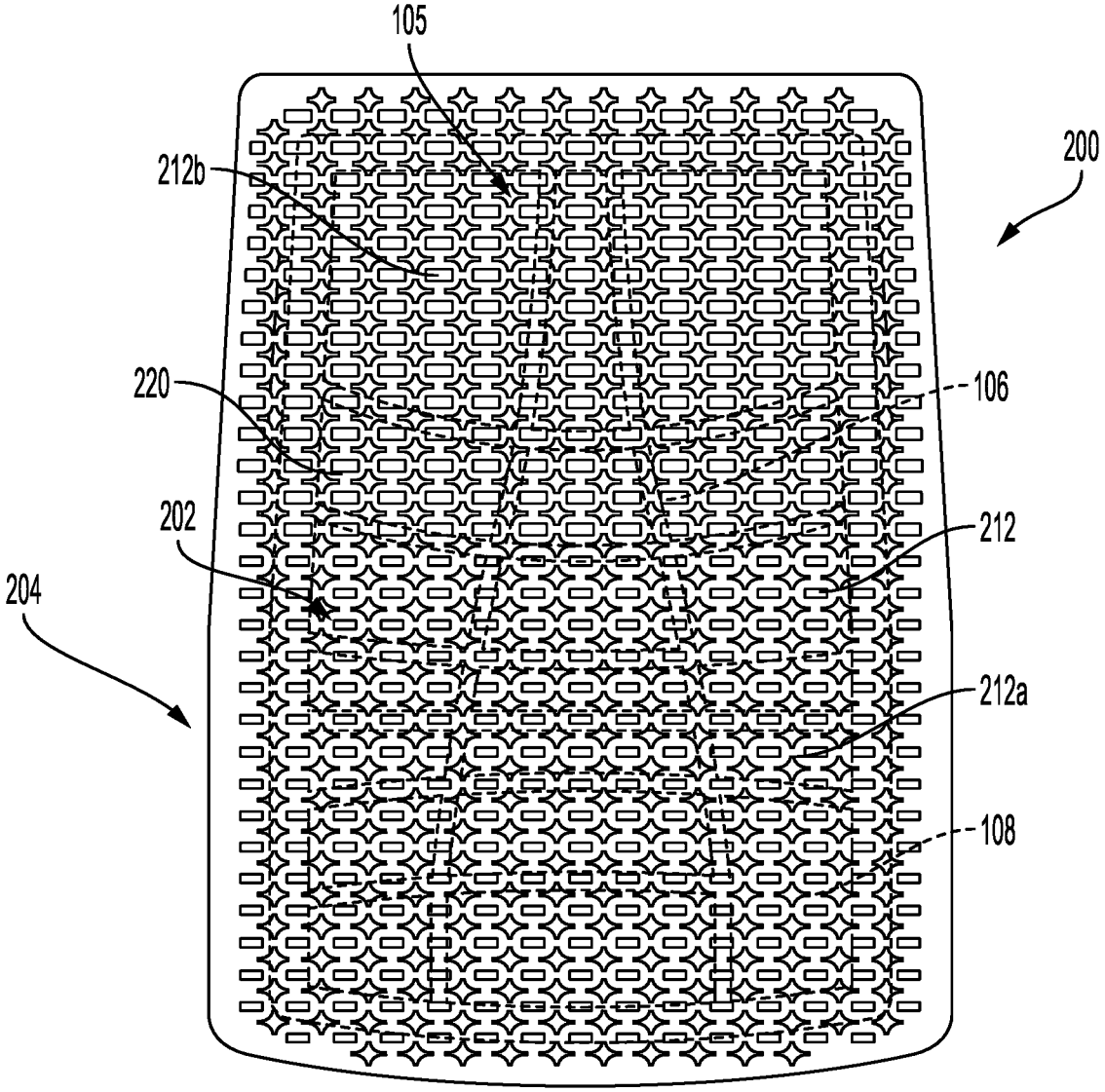
FIG. 4 is a front view of another exemplary embodiment of a chair back of the present invention similar to the chair back of FIG. 1, wherein the web-like structure is implemented through manipulation of scale size of individual scales present in the chair back.
Figure 5:
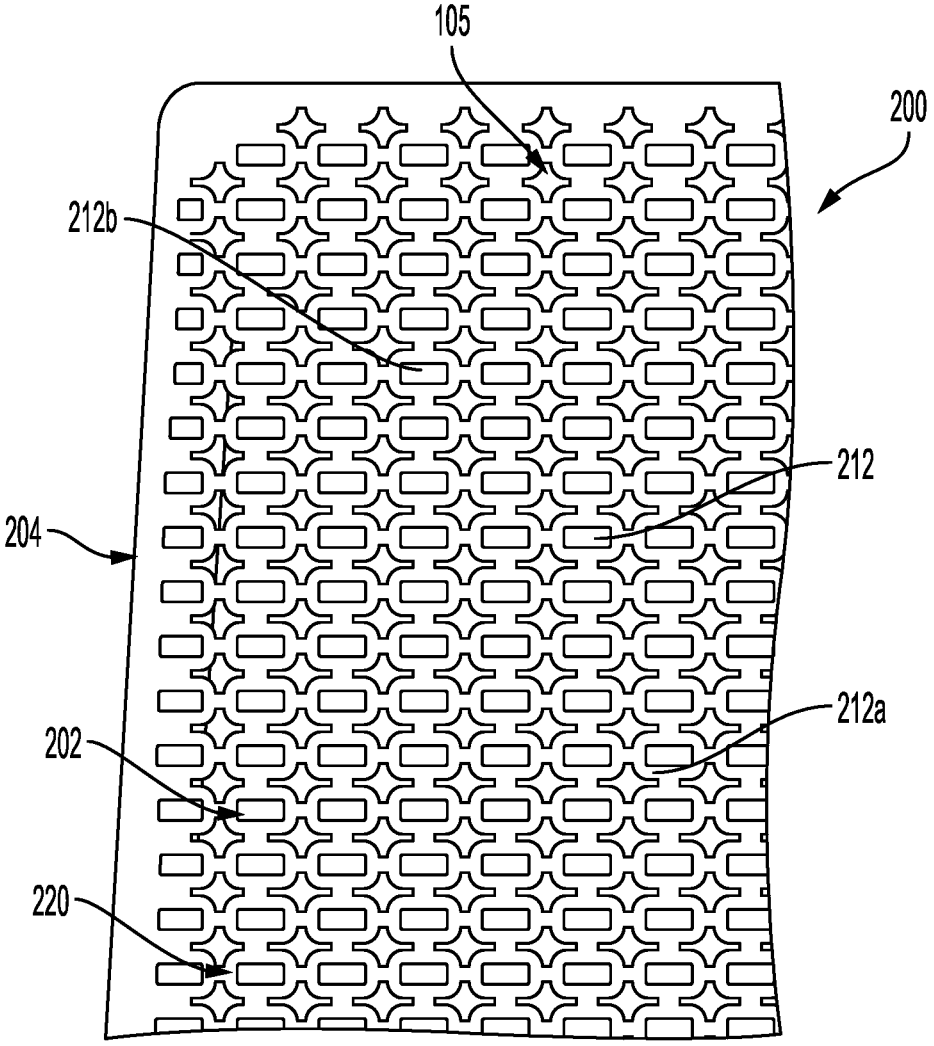
FIG. 5 is a close-up view of the scales of the chair back of FIG. 4, demonstrating the difference in scale size.

Referring now to FIGS. 4 and 5, another embodiment of a chair back 200 is disclosed. The chair back 200 includes an outer frame 204 and a body 202 comprised of a polymer forming a scale pattern 220 comprised of individual cells 212. In such an embodiment, the same web-like structure 105 is used, but instead of implementing the web-like structure 105 through an inner frame 102 (as shown in FIGS. 1 and 2), the structure is implemented through manipulation of the size of the individual cells 212. For illustration purposes, the web-like structure 105 of the present disclosure overlays the body 202 in FIG. 4. For example, where a vertical frame element 106 or a horizontal frame element 108 may be present in the inner frame 102 of the chair back 100 of the previous embodiment as shown in FIGS. 1 and 2, the size of an individual scale 212*a* is thicker and denser than the size of a lighter individual scale 212*b*, which is illustratively located where a horizontal zone within the web-like structure 105 of the inner frame 102 is located. The denser individual scale 212*a* provides greater resistance than the lighter individual scale 212*b*. Such an embodiment provides the beneficial support of the web-like structure 105 of the original embodiment without the additional step of foam-molding the chair back 200.

Various modifications and additions can be made to the exemplary embodiments discussed without departing from the scope of the present invention. For example, while the embodiments described above refer to particular features, the inventive scope also includes embodiments having different combinations of features and embodiments that do not include all of the above-described features. For example, in another embodiment, a web-like structure 105 may be included in the seat 5 of the chair 1 to provide additional support to the user.

What is claimed is:

1. A method of manufacturing a chair back, the method comprising:

coupling an inner frame to an outer frame such that the inner frame stretches across an open central region of the outer frame, the inner frame defining a central longitudinal axis and a central latitudinal axis and being formed of a web material including a crossing-pattern of inner frame elements that define a plurality of closed cells that are symmetric in shape about the central longitudinal axis of the inner frame, the inner frame elements including vertical elements extending along the central longitudinal axis and defining at least one vertical zone having a vertical zone width that changes along the central longitudinal axis, the web material being relatively less rigid than an outer frame material;

placing the inner frame and the outer frame into a chair mold; and depositing liquid foam into the chair mold to cover the inner frame and the outer frame.

2. The method of claim 1, further comprising allowing the liquid foam to dry in the chair mold to form a foam layer, the foam layer conforming to and holding the shape of the chair mold where a chair back is formed by the outer layer, the inner layer, and the foam layer.

3. The method of claim 1, further comprising removing the chair back from the chair mold after allowing the liquid foam layer to dry.

4. The method of claim 1, further comprising filling the plurality of closed cells of the inner frame with the liquid foam.

5. The method of claim 1, wherein coupling the inner frame to the outer frame further comprises heat-staking.

6. The method of claim 1, further a pulsed-heat process on at least one of the inner frame and the outer frame such that at least one of the inner frame and the outer frame is partially deformed and melted such that the inner frame and the outer frame are bonded together.

7. The method of claim 1, wherein coupling the inner frame to the outer frame further comprises coupling via fasteners.

8. The method of claim 1, wherein depositing liquid foam into the chair mold to cover the inner frame and the outer frame includes performing a casting process.

9. A method of manufacturing a chair back, the method comprising:

deforming at least one of an inner frame and an outer frame to bond the inner frame and the outer frame together, the outer frame defining an open central region and being formed of an outer frame material and the inner frame defining a central longitudinal axis and a central latitudinal axis, the inner frame being formed of a web material including a crossing-pattern of inner frame elements that define a plurality of closed cells that are symmetric in shape about the central longitudinal axis of the inner frame, the inner frame elements including at least one vertical frame element that extends along the central longitudinal axis, the at least one vertical frame element having a top portion spaced a first distance from the central longitudinal axis and a bottom portion spaced a second distance from the central longitudinal axis, wherein the second distance is greater than the first distance, and wherein the web material is relatively less rigid than the outer frame material;

placing the inner frame and outer frame into a chair mold; and depositing liquid foam into the chair mold to cover at least a portion of each of the inner frame and the outer frame.

10. The method of claim 9, wherein deforming at least one of the inner frame and the outer frame to bond the inner frame and the outer frame together further comprises melting at least one of the inner frame and the outer frame.

11. The method of claim 10, further comprising cooling the inner frame and the outer frame prior to placing the inner frame and the outer frame in the chair mold.

12. The method of claim 9, wherein deforming at least one of the inner frame and the outer frame to bond the inner frame and the outer frame together further comprises arranging the inner frame such that the inner frame is extended across the open central region of the outer frame.

13. The method of claim 9, further comprising allowing the liquid foam to dry in the chair mold to form a foam layer, the foam layer conforming to and holding the shape of the chair mold where a chair back is formed by the outer layer, the inner layer, and the foam layer.

14. The method of claim 9, further comprising removing the chair back from the chair mold after allowing the liquid foam layer to dry.

15. The method of claim 9, further comprising allowing the liquid foam to fill the plurality of closed cells of the inner frame.

16. The method of claim 9, wherein depositing liquid foam into the chair mold to cover at least a portion of each of the inner frame and the outer frame further comprises performing a casting process.

17. A method of manufacturing a chair back, the method comprising:

coupling an inner frame to an outer frame so that the inner frame stretches across an open central region of the outer frame, the outer frame being formed of an outer frame material and the inner frame defining a central longitudinal axis and a central latitudinal axis, the inner frame being formed of a web material including a crossing-pattern of inner frame elements that define a plurality of closed cells that are symmetric in shape about the central longitudinal axis of the inner frame, wherein the web material is relatively less rigid than the outer frame material, the inner frame elements including a first vertical frame element and a second vertical frame element that each extend along the central longitudinal axis, wherein the first vertical frame element and the second vertical frame element diverge from one another along the central longitudinal axis;

placing the inner frame and the outer frame into a chair mold; and depositing liquid foam into the chair mold via injection molding to cover the inner frame and the outer frame.

18. The method of claim 17, further comprising allowing the liquid foam to dry in the chair mold to form a foam layer, the foam layer conforming to and holding the shape of the chair mold where a chair back is formed by the outer layer, the inner layer, and the foam layer.

19. The method of claim 17, further comprising removing the chair back from the chair mold after allowing the liquid foam layer to dry.

20. The method of claim 17, further comprising filling the plurality of closed cells of the inner frame with the liquid foam.

* * * * *